United States Patent [19]

Patalon

[11] Patent Number: 4,582,482

[45] Date of Patent: Apr. 15, 1986

[54] TOP-FIRED, WALKING HEARTH-TYPE FURNACE

[75] Inventor: Heinrich Patalon, Bochum, Fed. Rep. of Germany

[73] Assignee: Didier Engineering GmbH, Essen, Fed. Rep. of Germany

[21] Appl. No.: 638,612

[22] Filed: Aug. 7, 1984

[30] Foreign Application Priority Data

Sep. 21, 1983 [DE] Fed. Rep. of Germany ..... 3334015

[51] Int. Cl.[4] ..... F27B 9/14; F27B 9/02; F27D 3/00

[52] U.S. Cl. ..... 432/124; 432/128; 432/239

[58] Field of Search ..... 432/124, 125, 128, 239

[56] References Cited

U.S. PATENT DOCUMENTS

| | | | |
|---|---|---|---|
| 1,851,913 | 3/1932 | Lauge | 432/239 |
| 3,373,980 | 3/1968 | Borgkvist | 432/11 |
| 3,471,134 | 10/1969 | Cone | 432/239 |
| 4,492,565 | 1/1985 | Feroldi | 432/11 |

FOREIGN PATENT DOCUMENTS

| | | | |
|---|---|---|---|
| 1143841 | 2/1963 | Fed. Rep. of Germany | 432/124 |
| 1561203 | 2/1969 | France | 432/124 |

*Primary Examiner*—John J. Camby

*Attorney, Agent, or Firm*—Wenderoth, Lind & Ponack

[57] ABSTRACT

A top-fired, lifting or walking, hearth-type furnace includes an upstream preheating zone and a downstream primary heating zone. Stock, such as billets or ingots, to be heated is passed sequentially through the preheating zone and primary heating zone. Each zone has therein support members for supporting the stock. The support members of the preheating zone are at a level higher than the support members of the primary heating zone, with a step therebetween, whereby hot flue gases in the preheating zone circulate upwardly around the support members therein and the stock supported thereby. A lowering and lifting apparatus is located at the step to transfer stock from the support members of the preheating zone to the support members of the primary heating zone.

5 Claims, 4 Drawing Figures

TOP-FIRED, WALKING HEARTH-TYPE FURNACE

BACKGROUND OF THE INVENTION

The present invention relates to a top-fired, lifting or walking, hearth-type furnace for the heating of billets, ingots or similar stock by means of hot flue gases circulating through the furnace.

Even during the initial phase of heating by means of this type of furnace, the heating of such stock must occur as evenly as possible in order to prevent stock from cracking or bending, such occurrences being caused by internal stresses as a result of uneven heating. If the temperature of the stock increases too rapidly, the stock may warp on the upper or lower side due to varying temperature effects. Therefore, in the past this type of furnace has been operated at low temperatures in a preheating zone or has been equipped with expensive mechanisms for turning over the stock to ensure uniform heating thereof.

SUMMARY OF THE INVENTION

With the above discussion in mind, it is the primary object of the present invention to provide an improved top-fired, lifting or walking, hearth-type furnace of a simple design, whereby it is possible to heat stock as uniformly as possible on all sides.

This object is achieved in accordance with the present invention by providing the furnace with a stepped hearth. Thus, the furnace includes an upstream preheating zone and a downstream primary heating zone, whereby stock to be heated is passed sequentially through the preheating and primary heating zones, each zone having therein support members for supporting the stock to be heated. The support members of the preheating zone are at a level higher than the support members of the primary heating zone, with a step therebetween. Thus, hot flue gases in the preheating zone circulate upwardly around the support members therein and the stock supported thereby. A transfer device is located at the step to transfer the stock from the support members of the preheating zone down to the level of the support members of the primary heating zone. This transfer device is in the form of a lowering and lifting apparatus.

By the above arrangement according to the present invention, it is possible to heat the stock in the preheating zone essentially from the bottom to the top thereof, and to heat the stock in the primary heating zone essentially from the top thereof. In this way, it is possible to achieve a substantial production efficiency while maintaining a sufficiently uniform heating of the stock. Transfer of the stock downwardly is achieved by the lifting and lowering apparatus at the step between the preheating zone and the primary heating zone.

In an advantageous arrangement of the present invention, the lowering and lifting apparatus includes vertically movable members, such as rams or rods, for receiving the stock at the level of the support members of the preheating zone and for lowering such stock therefrom to the level of the support members of the primary heating zone. The transfer means may include means for moving the lowering and lifting apparatus horizontally with the vertically movable members passing between support members of the primary heating zone, the extent of horizontal movement being not much greater than the diameter or the dimension in the direction of movement of the stock to be heated.

Advantageously, the furnace includes, at the preheating zone, stationary hearth portions supporting the stock to be heated and movable hearth portions operable to sequentially lift the stock from the stationary hearth portions and to advance the stock therealong, and also to transfer the stock from the downstreammost end of the stationary hearth portions to the vertically movable members of the lowering and lifting apparatus. In this manner, the stock is transported step-by-step in the downstream direction through the preheating zone. At the downstream end of the preheating zone, the movable hearth members deposit the stock on the vertically movable members of the lifting and lowering apparatus. In a similar manner, the furnace includes, at the primary heating zone, stationary hearth portions supporting the stock and movable hearth portions operable to sequentially lift the stock from the stationary hearth portions and to advance the stock step-by-step therealong in the downstream direction. The support members are mounted on the respective stationary hearth portions and movable hearth portions.

The vertically movable members have at upper ends thereof exchangeable wear-resistant caps. Advantageously, the downstream ends of the caps may have extending upwardly therefrom projections to aid in retaining the stock which is transferred to the vertically movable members.

The support members may be formed of a ceramic or of heat resistant steel or cast iron materials.

In accordance with a further arrangement or embodiment of the present invention, tubing, for example cooled tubing, may be employed as the movable hearth portions or may be mounted thereon for directly supporting the stock during sequential movement thereof. Such tubing may have at the downstream leading ends thereof "goose neck" shaped portions or curved portions dimensioned to enable transfer of the stock from the downstream end of the stationary hearth portions to the vertically movable members of the lowering and lifting apparatus.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
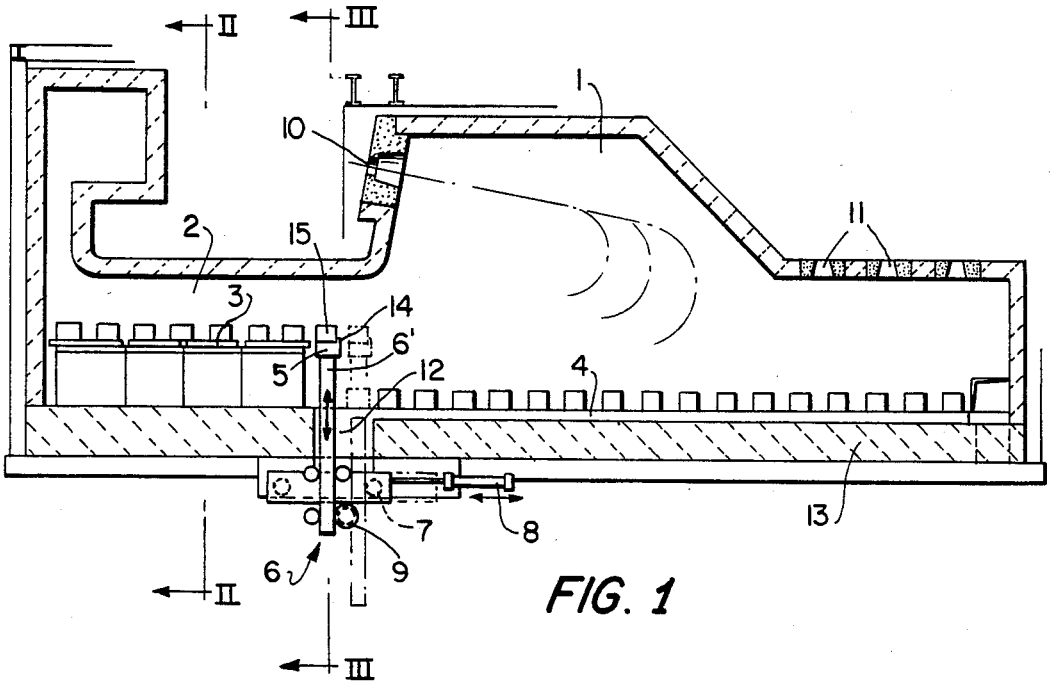
FIG. 1 is a schematic vertical longitudinal section through a furnace in accordance with one embodiment of the present invention.
Figure 2:
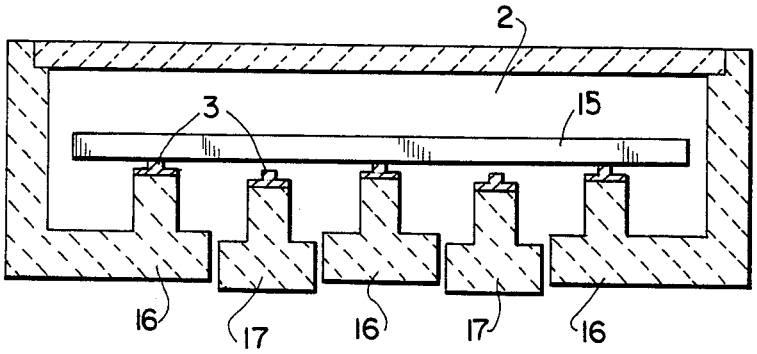
FIG. 2 is a transverse section taken along line II—II of FIG. 1.
Figure 3:
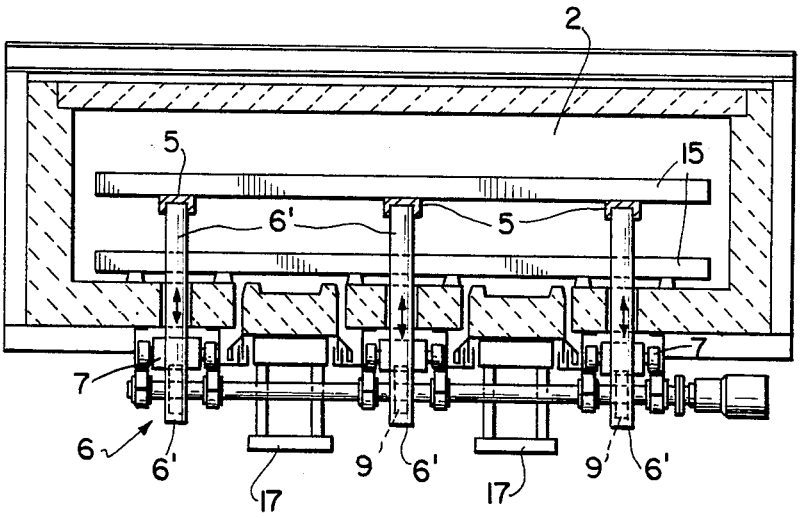
FIG. 3 is a transverse section taken along line III—III of FIG. 1.

With reference now to FIGS. 1–3, a first embodiment of the present invention will be described in more detail. Thus, a top-fired, lifting or walking, hearth-type furnace according to the present invention includes a normal furnace enclosure defining therein an upstream preheating zone 2 and a downstream primary heating zone 1. The stock 15 to be heated, for example billets, ingots or similar stock, is transported through preheating zone 2 and primary heating zone 1 in a step-by-step manner, during which the stock is heated.

As will be apparent particularly from FIG. 2, the bottom or hearth of the furnace, at the preheating zone 2, includes upwardly extending stationary hearth portions 16 and movable hearth portions 17. The upper ends of hearth portions 16, 17 have mounted thereon support members 3 formed of ceramic or heat resistant steel or cast iron material. The stock 15 to be heated is lifted step-by-step from the support members 3 of the stationary hearth portions 16 by means of the movable hearth portions 17 and is moved forward and then again deposited on the fixed hearth portions 16. Those skilled in the art readily understand the specific construction of this type of lifting or walking hearth furnace.

The primary heating zone 1 also includes a bottom or hearth including similar stationary hearth portions and movable hearth portions, such that the stock 15 also is moved in a step-by-step manner throughout the primary heating zone. The hearth portions of the primary heating zone also have support members 4 similar to support members 3 discussed above.

In accordance with the present invention, the furnace has an internal "step" therein, such that the support members 3 of the preheating zone 2 are at a level higher than the support members 4 of the primary heating zone 1. As a result, the hot flue gases which pass through the interior of the furnace, in a manner known by those skilled in the art, will circulate upwardly around the support members 3 and the stock 15 supported thereby in the preheating zone 2. As a result, in the preheating zone the stock is primarily heated from the bottom. On the other hand, in the primary heating zone 1 the stock primarily will be heated from the top.

At the step between the support members 3 and 4 is provided means for transferring stock 15 from support members 3 to support members 4. The specifically illustrated transfer means is in the form of a lowering and lifting apparatus 6 including vertically moving members 6′, for example in the form of rams or rods as illustrated. During sequential transfer of the stock through the preheating zone 2, the stock from the downstream end of stationary hearth portions 16 is transferred by the movable hearth portions 17 to the top ends of the vertically movable members 6′. That is, upon lowering of the movable hearth portions 17, the downstreammost stock 15 is deposited on the tops of members 6′.

The lowering and lifting apparatus 6 is mounted on a trolley or cart 7 which can be moved horizontally in the direction indicated by the double-headed arrow in FIG. 1, for example by means of piston-cylinder arrangement 8. Accordingly, vertically movable members 6′ can be moved between the support members 4 in the primary heating zone 1. The members 6′ then are moved downwardly, for example by gear-rack drives 9, until the stock 15 is deposited on the upstream ends of support members 4. The lowering and lifting apparatus then is moved back to the initial position shown by solid lines in FIG. 1 to receive a new stock 15 in the manner described above.

The upper ends of members 6′ have wear-resistant caps or heads 5 to prevent damage to the upper ends of the rods. As shown somewhat schematically in FIG. 1, the forward or downstream ends of caps 5 may have extending therefrom nose-like projections 14 to prevent the stock 15 from tipping over the edges of the vertically movable members. Slots 12 for the upward movement of members 6′ are sealed off, for example by means of water seals, as will be apparent to those skilled in the art. To achieve uniform washing and heating of stock 15, the furnace of the present invention is heated with reverse firing system 10 and roof burners 11.

The lining 13 of the hearth or bottom of the furnace comprises high quality insulation material that does not come into contact with the stock 15 due to the provision of support members 4 and due to the manner of transfer.

The lowering and lifting mechanism 6 is shown in more detail in FIG. 3.

Figure 4:
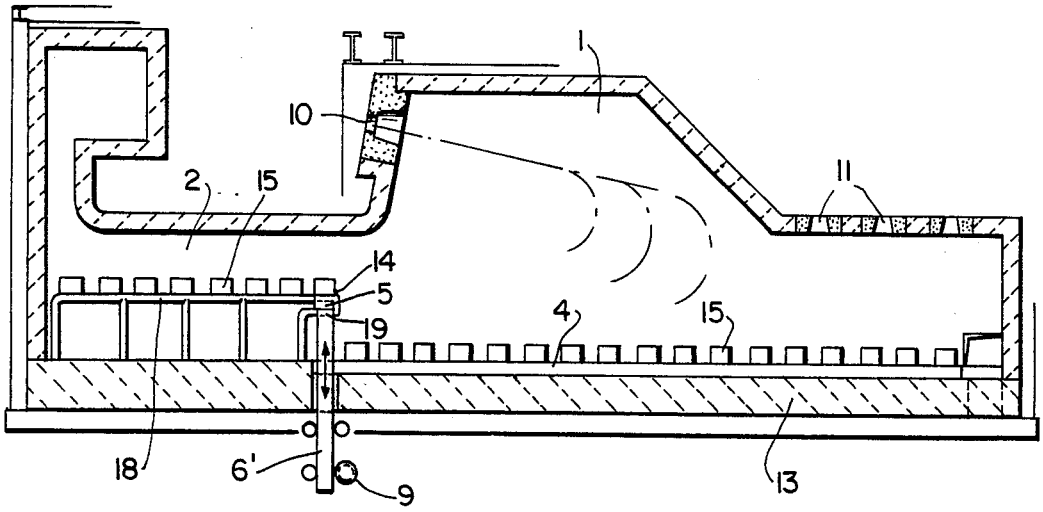
FIG. 4 is a view similar to FIG. 1 but of another embodiment of the present invention.

FIG. 4 shows a somewhat modified embodiment of the present invention. In this embodiment, the lowering and lifting mechanism 6 includes only vertically movable members 6′, and specifically does not include the arrangement for horizontal movement of the apparatus. The stock 15 to be heated rests in the preheating zone on a structure formed of tubing 18, for example cooled tubing, which is placed only on the movable hearth portions 17 for the forward transport of the stock through preheating zone 2. Tubing 18 may be placed on the movable hearth portions 17, which could be modified accordingly. The stationary hearth portions 16 remain unchanged, i.e. are as described and illustrated above regarding the first embodiment. The downstream or forward end of tubing 8 has a bent portion 19 of reduced height dimensioned to enable transfer of the downstreammost stock to the members 6′ during lowering of the movable hearth portions.

Although the present invention has been described and illustrated with respect to preferred features thereof, it is to be understood that various modifications and changes may be made to the specifically described and illustrated arrangements without departing from the scope of the present invention.

I claim:

1. A top-fired, lifting or walking, hearth-type furnace for the heating of billets, ingots or similar stock by means of hot flue gases, said furnace comprising:

a furnace enclosure defining therein an upstream preheating zone and a downstream primary heating zone;

said preheating zone including a bottom having extending upwardly therefrom stationary hearth portions for supporting stock to be heated;

said primary heating zone including a bottom having support members for supporting the stock to be heated;

said furnace enclosure including a top having therein burner means for generating flue gases for heating the stock;

said stationary hearth portions of said preheating zone being at a level sufficiently above the level of said support members of said primary heating zone, with a step therebetween, such that hot flue gases generated by said burner means circulate upwardly in said preheating zone between said stationary hearth portions and around the stock supported thereby;

vertically movable members located at said step for receiving stock at said level of said stationary hearth portions of said preheating zone and for lowering the stock therefrom to said level of said support members of said primary heating zone; and movable hearth portions, within said preheating zone and separate from said vertically movable members, for sequentially lifting the stock from said stationary hearth portions and advancing the stock therealong and for transferring the stock from the downstreammost end of said stationary hearth portions to said vertically movable members.

2. A furnace as claimed in claim 1, further comprising protective support members of said preheating zone are provided on said stationary hearth portions and on said movable hearth portions thereof.

3. A furnace as claimed in claim 1, further comprising means for moving said vertically movable members horizontally with said vertically movable members passing between said support members of said primary heating zone, and means for lowering said vertically movable members such that upper ends thereof are lowered below the level of said stationary hearth portions of said primary heating zone.

4. A furnace as claimed in claim 1, wherein said vertically movable members have at upper ends thereof exchangeable wear-resistant caps.

5. A furnace as claimed in claim 4, wherein downstream ends of said caps have extending upwardly therefrom stock retaining projections.

* * * * *